US005584763A

United States Patent [19]

Kelly et al.

[11] Patent Number: 5,584,763

[45] Date of Patent: Dec. 17, 1996

[54] ARCADE GAME HAVING MULTIPLE ROTATING POINTERS

[75] Inventors: Bryan M. Kelly, Almo; Matthew F. Kelly, San Ramon; Kevin A. Heyes; Steven S. Pi, both of San Jose, all of Calif.

[73] Assignee: Acclaim Redemption Games, Inc., Pleasanton, Calif.

[21] Appl. No.: 393,304

[22] Filed: Feb. 22, 1995

[51] Int. Cl.[6] ..... A63B 71/06

[52] U.S. Cl. ..... 463/16; 463/7; 463/10; 273/139

[58] Field of Search ..... 463/7, 16, 27, 463/10; 364/410–412; 340/323 R; 273/127 D, 141 A, 142 B, 139

[56] References Cited

U.S. PATENT DOCUMENTS

| | | | |
|---|---|---|---|
| 810,299 | 1/1906 | Pettee . | |
| 941,194 | 11/1909 | Hamilton . | |
| 1,543,318 | 6/1925 | Cardoza . | |
| 1,652,071 | 12/1927 | Tsujino . | |
| 2,043,166 | 6/1936 | Hart et al. | 273/138 |
| 2,141,580 | 12/1938 | White | 273/95 |
| 2,660,434 | 11/1953 | Durant | 273/121 |
| 2,799,500 | 7/1957 | Zekowski | 273/1 |
| 3,796,433 | 3/1974 | Fraley et al. | 273/138 |
| 3,843,129 | 10/1974 | Dietrich | 273/120 |
| 3,975,022 | 8/1976 | Figueroa | 273/141 |
| 4,240,635 | 12/1980 | Brown | 273/138 |
| 4,743,024 | 5/1988 | Helm et al. | 273/143 |
| 4,837,728 | 6/1989 | Barrie et al. | 364/412 |
| 4,948,133 | 8/1990 | Helm et al. | 273/85 |
| 4,964,638 | 10/1990 | Ishida | 273/138 |
| 5,016,880 | 5/1991 | Berge | 273/138 |
| 5,048,833 | 9/1991 | Lamle | 273/138 |
| 5,184,821 | 2/1993 | Korenek | 273/138 |
| 5,249,800 | 10/1993 | Hilgendorf et al. | 273/138 |
| 5,280,909 | 1/1994 | Tracy | 273/138 |
| 5,286,023 | 2/1994 | Wood | 273/138 |
| 5,292,127 | 3/1994 | Kelly et al. | 273/138 |
| 5,318,298 | 6/1994 | Kelly et al. | 273/122 |

*Primary Examiner*—Jessica Harrison
*Assistant Examiner*—Mark A. Sager

[57] ABSTRACT

An arcade game apparatus of the present invention includes a display face having indicia provided thereon and multiple pointers rotatable in opposite directions about a single axis on the display face. Control mechanisms allow a player to start and stop the rotation of the pointers. A game score is calculated based on the indicia that the pointers are pointing to after they have stopped rotating. The game score is calculated in a described embodiment by summing numeral indicia pointed to by the pointers. An award dispenser dispenses an award based upon the game score. Multiple arcade game apparatus of the present invention can also be connected to a progressive bonus apparatus that accumulates a progressive score contributed to by each individual game apparatus. A player of an individual game apparatus may win an award based on the progressive score by achieving a progressive goal on the individual game apparatus.

35 Claims, 5 Drawing Sheets

ARCADE GAME HAVING MULTIPLE ROTATING POINTERS

BACKGROUND OF THE INVENTION

1. Field of the Invention

This invention relates to games normally played in an arcade environment, and more particularly to games which include rotating pointers to indicate a score.

2. Background of the Related Art

Games of many types are played in arcade environments. One type of game provides a pointer which rotates about a central axis and points to one of multiple numbers or symbols positioned around the periphery of the pointer.

An example of a game that includes a rotating pointer can be found in U.S. Pat. No. 2,799,500, of G. I. Zekowski, which describes a game device which includes a spinning disc having a pointer arrow displayed thereon. The pointer arrow can be started and stopped by pushing buttons provided to the player.

Another example is found in U.S. Pat. No. 3,975,022, of Figueroa, which describes a parlor game device having two rotating pointers provided on two separate dial faces. A random arithmetic result of the two pointers is indicated on a score panel.

The rotating pointer games of the prior art, while enjoyable, are rather simple games and, as such, often lead to rapid player boredom. This is undesirable in an arcade environment where revenues are directly related to the continuous, repeated use of the games. It is believed that an arcade game which incorporates skilled operation from a player to stop multiple pointers would remain more interesting to players and generate greater revenues for the arcade owner.

SUMMARY OF INVENTION

The present invention provides an arcade game having multiple pointers that rotate about the same axis. A player can select when to stop the pointers and receive a score based on indicia pointed to by the pointers. This improvement allows players to play a game having greater player control and skill required to achieve a desired result.

A game apparatus of the present invention includes a display face having indicia provided thereon and multiple pointers rotatable about an axis extending substantially perpendicularly from the display face. A control mechanism allows a player to stop the pointers from rotating, and a scoring mechanism provides a game score based on the indicia that the pointers are pointing to after they have stopped rotating. A control mechanism is also preferably included to allow a player to cause the pointers to rotate about the axis. The control mechanisms preferably take the form of stop and spin buttons, respectively. The pointers are preferably elongated members and include, in the described embodiment, a pointer that is rotatable in a clockwise direction and a pointer that is rotatable in a counterclockwise direction. In one embodiment, the indicia pointed to by the pointers are numerals, and the game score is calculated by summing the numerals pointed to by the pointers. In another embodiment, the indicia are card symbols and a game score is calculated based on a combination of card symbols pointed to by the pointers. An award dispenser dispenses an award based upon the game score.

The mechanism for rotating the pointers of the preferred embodiment includes a motor for each of two pointers. Preferably, each motor is coupled to a shaft, where a first one of the shafts directly couples a first motor to one of the pointers. The second shaft couples the second motor to a gear assembly, which is coupled to the other pointer by a third shaft. The first shaft is positioned inside the third shaft, centered on the axis of rotation of the pointers, and allows both pointers to be independently rotated about the axis. The rotation mechanism also includes a sensor assembly that determine which indicia the pointers are pointing to. The sensor assembly includes a sensor wheel having multiple notches corresponding to the indicia and an emitter/detector for sensing the positions of the notches as the sensor wheel is rotated. Preferably, a digital computer controls the rotation and sensing of the pointers. In the described embodiment, a single or multiple game apparatuses can accumulate a progressive score for a player. A player of an individual game apparatus may win an award based on the progressive score by achieving a progressive goal on the individual game apparatus. Multiple arcade game apparatuses can be connected to a progressive bonus apparatus that accumulates a progressive score contributed to by each individual game apparatus.

A method for playing an arcade game having multiple rotatable pointers includes the steps of providing a plurality of pointers, rotating the pointers about a single axis when a player inserts a game token and activates a control, stopping the pointers to rest at stopped positions when the player activates a different control, and providing a game score based on the stopped positions of the pointers. Indicia are preferably arranged on a display face by which the pointers can indicate a score. In o ne preferred embodiment, the indicia are numbers, and the numbers which are pointed to by the pointers are summed to calculate a game score. An award, such as redemption tickets, is preferably dispensed to player based on the game score. A progressive bonus award can be provided to the player if the player achieves a progressive goal during a game.

The arcade game of the present invention includes multiple pointers that rotate about a single axis. The player must exercise skill and control in deciding when to stop the pointers to receive a high score and also has the option of receiving a progressive bonus score. The present invention thus provides a more interesting and demanding game than the pointer games of the prior art.

These and other advantages of the present invention will become apparent to those skilled in the art after reading the following descriptions and studying the various figures of the drawings.

DETAILED DESCRIPTION OF THE PREFERRED EMBODIMENTS

Figure 1:
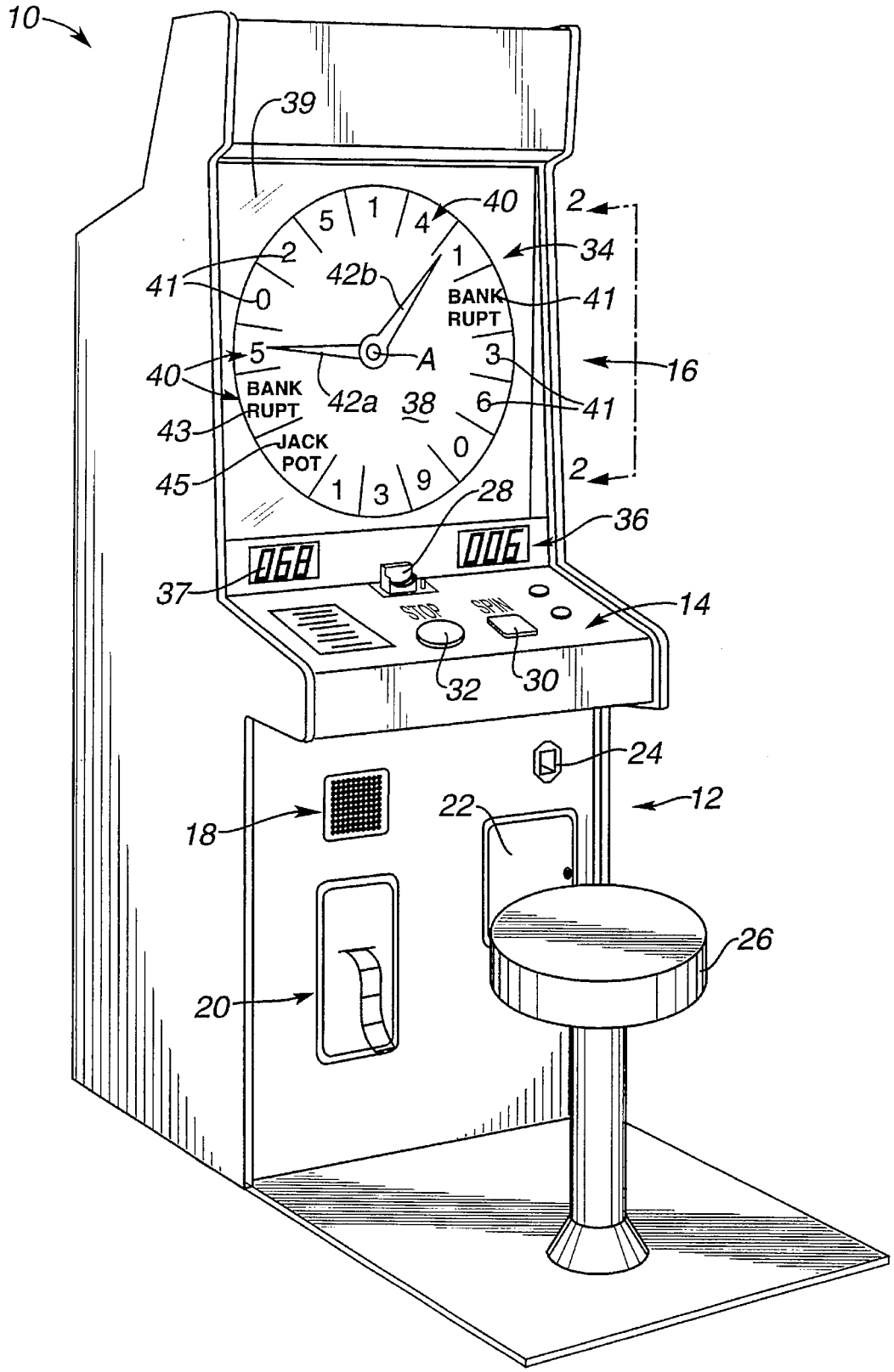
FIG. 1 is a perspective view of a preferred embodiment of the game apparatus of the present invention.

FIG. 1 is a perspective view of a preferred embodiment of a game apparatus 10 in accordance with the present invention. Game apparatus 10 includes a front panel section 12, player controls 14, and a display section 16.

Front panel section 12 includes a speaker 18, an award dispenser 20, a cash box panel 22, and a coin return 24. A stool 26 or other chair or platform can be included to allow a player to sit while playing game apparatus 10.

The speaker 18 emits sounds based on game actions and other game states and is controlled by the game unit controller system. The operation of the speaker will be discussed in greater detail subsequently.

Award dispenser 20 preferably dispenses a ticket award to the player based upon the result of a game in progress. In this present embodiment, tickets may be accumulated and redeemed to win various prizes. Ticket dispensing mechanisms are well-known in the prior art. Other types of awards besides tickets may be dispensed by award dispenser 34. For example, sports cards or other trading cards, toy prizes, or even coins or currency can be dispensed. The awards are stored in a storage area behind the front panel 12.

Cash box panel 22 allows an operator of game apparatus 10 to access coins or other tokens that have been deposited by a player and have been stored in a cash box positioned behind front panel 12. Such coin boxes are well known in the art.

Coin return slot 24 returns a coin or token that was inserted in the coin slot (described below) to the player in the event the coin becomes trapped in the coin mechanism, etc. The player can activate a return button that is well known in the art.

Player controls 14 are used by the player to operate game apparatus 10, and are preferably positioned above front panel 12 and below display section 16, although other layouts can be implemented in alternate embodiments. Player controls 14 preferably include a coin deposit slot 28, a spin button 30, and a stop button 32. Other controls can also be provided in the same general area of game apparatus 10, such as buttons to select the number of players playing the game, options during the game, etc.

Coin deposit slot 28 preferably accepts standard currency coins or game tokens that are often available in an arcade environment. A game begins after a coin or token has been inserted by the player. Preferably, once the coin has been inserted, the pointers in the display section 16 (described below) rotate and stop at a default position, such as both pointers pointing towards the top of game apparatus 10 or to a specific number in display section 16.

Spin button 30 allows the player to control when the game action begins. When spin button 30 is depressed, the pointers in display section 16 begin rotating from their default beginning position. Stop button 32, when depressed by a player, causes the pointers to immediately stop rotating. A score is then calculated based on the final positions of the pointers. Other controls can be used in other embodiments instead of buttons 30 and 32. For example, joystick(s) can be used to start and stop the pointers, one or more knobs can be turned, etc.

Display section 16 includes a pointer section 34 and score displays 36 and 37. Pointer section 34 includes a display face 38, indicia 40, and pointers 42*a* and 42*b*. In the preferred embodiment, display section 16 includes a transparent cover 39, such as plastic or glass, positioned about half an inch to an inch above the display face 38 which prevents players from directly interfering with game action or mechanisms on the display face. Display face 38, in the described embodiment, is a circular face that provides an area for pointers 42 to spin. In alternate embodiments, display face 38 can be provided as rectangular, triangular, or any other desired figure or shape. Alternatively, no display face is designated in display section 16.

A number of indicia 40 are preferably displayed near the perimeter of display face 38. Indicia 40 are used to indicate a game result to the player based on which indicia are pointed to by pointers 42*a* and 42*b*. Pointers 42*a* and 42*b* are preferably elongated members having one end positioned at or near the center of display face 38 at an axis A, where axis A extends substantially perpendicularly from display face 38. Pointers 42*a* and 42*b* are operative to rotate or spin about axis A at the end of the pointers positioned at axis A. The mechanism used to rotate pointers 42*a* and 42*b* is detailed with respect to FIG. 2. In the described embodiment, two pointers are shown. Alternatively, three or more pointers can be provided, where each pointer can point to different indicia 40 on display face 38. Pointers 42*a* and 42*b* are shown as elongated members that rotate with reference to display face 38. Alternatively, circular, transparent members, each having a pointer 42*a* or 42*b* image displayed thereon, can be rotated about axis A, similar to a disc or dial.

In the preferred embodiment, pointer 42*a* is rotated in one direction (such as clockwise), and pointer 42*b* is rotated in the opposite direction (such as counterclockwise) to provide a certain degree of difficulty in the game and require greater skill from the player to achieve a desired score. The speed of rotation of each pointer 42*a* and 42*b* can also preferably be independently varied to further change the difficulty of the game. In other embodiments, the pointers 42*a* and 42*b* can be rotated in the same direction or can be alternately rotated in the same and opposite directions during game play, as described subsequently.

In the described embodiment, indicia 40 include numbers 41 which indicate the score of the player. The game score is calculated by adding the numbers pointed to by pointers 42 after the pointers have stopped rotating. Indicia 40 also preferably include "bankrupt" indicia 43 and "jackpot" indicia 45. If either pointer 42*a* or 42*b* points to bankrupt indicia 43, the player's score is set to zero. If either pointer 42*a* or 42*b* points to jackpot indicia 45, then a predetermined score is added to the player's score during normal game play. In the preferred embodiment, if a pointer points to a jackpot indicium for multiple times in a row, the player wins a progressive bonus award (explained below with reference to FIGS. 6 and 8).

Score displays 36 and 37 are used to display current scores for a game to the player. Game score display 36 is used to display the current game score to the player based on the indicia pointed to by pointers 42*a* and 42*b*. Game score is described with reference to FIG. 8. Progressive score display 37 preferably displays the current progressive score that will be added to the game score if the progressive goal is achieved. The progressive score and goals are described with reference to FIG. 6. Additional score displays can be used to provide scores for multiple players of game apparatus 10 or provide other functions during game play. A number of awards, such as tickets, are preferably dispensed from award dispenser 20 based on the final game score. In other embodiments, score displays 36 and 37 can be positioned in other areas of game apparatus 10, such as on front panel 12 or above display area 16.

Buttons 58 can be used by the player of the game to make various selections concerning game play. For example, a player could select a one-or two-player game, the preferred award type, a progressive option, etc.

The game score display, player control, coin detection, award dispensing, and other functions of the game apparatus are preferably controlled by a control system. This system is described in detail with respect to FIG. 5.

Figure 2:
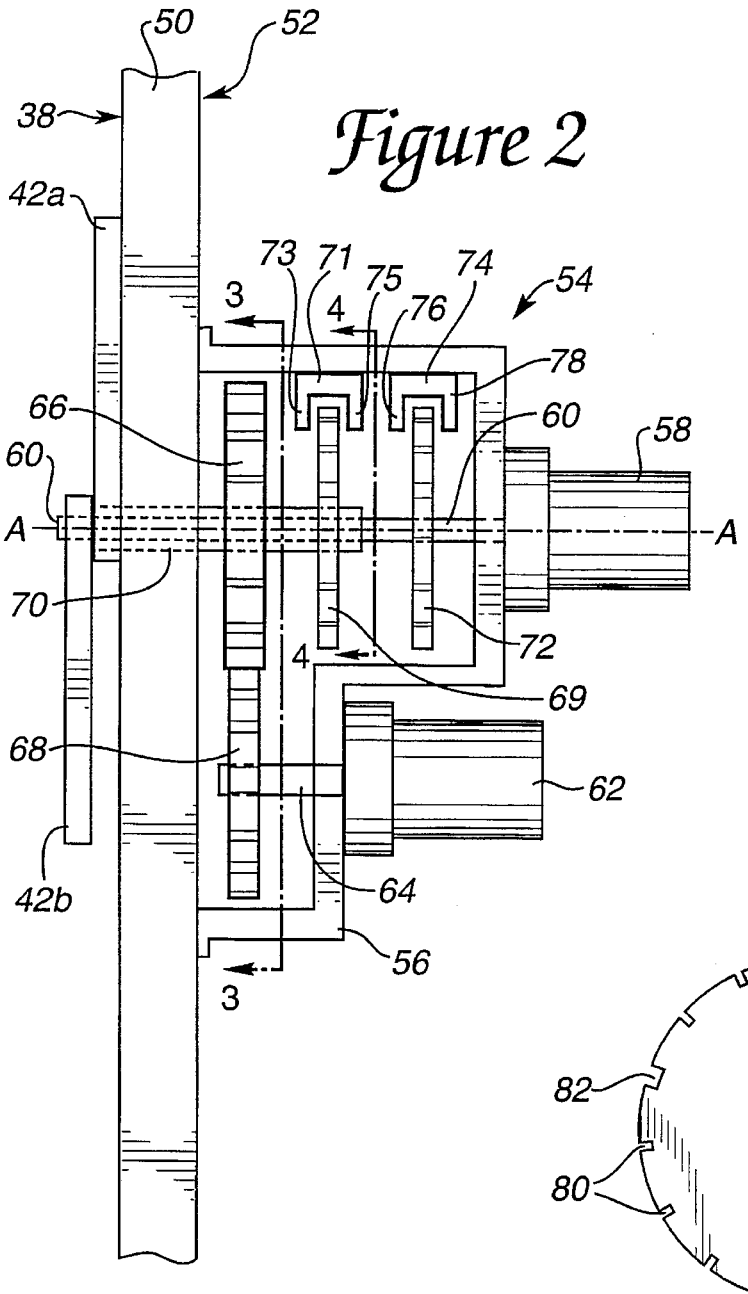
FIG. 2 is a side elevational view taken along line 2—2 of FIG. 1 of a rotation mechanism of the game apparatus.

FIG. 2 is an elevational side view of pointer section 34 taken along line 2—2 of FIG. 1. A planar member 50 includes front display face 38 as described above and a back surface 52. Coupled to back surface 52 is a preferred mechanism 54 used to rotate pointers 42*a* and 42*b* and sense which indicia the pointers are pointing to. Mechanism 54 includes a support member 56, a first motor 58, a first shaft 60, a second motor 62, a second shaft 64, a first gear 66, a second gear 68, a third shaft 70, a first sensor wheel 69, a first sensor 71, a second sensor wheel 72, and a second sensor 74.

Support member 56 is coupled to back surface 52 of planar member 50 and supports first motor 58 and second motor 62 used to rotate pointers 42*a* and 42*b* on display face 38 about axis A. First motor 58 is coupled to first shaft 60 and rotates shaft 60 when instructed to by the control system of game apparatus 10. First motor 58 is preferably positioned such that shaft 60 is centered on axis A. Pointer 42*b* is coupled to shaft 60 and is thus rotated by first motor 58 about axis A.

Figure 3:
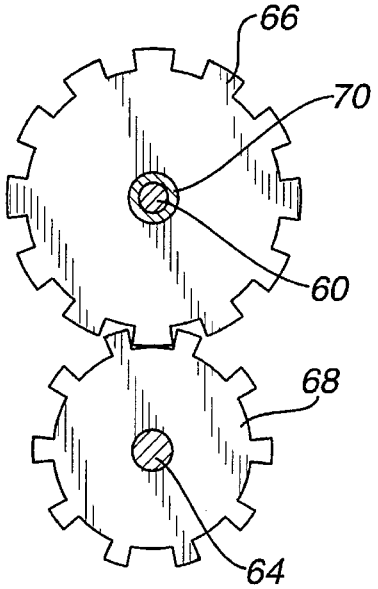
FIG. 3 is a front view taken along line 3—3 of FIG. 2 of gears used in the rotation mechanism.

Second motor 62 is also supported by support member 56 and is preferably positioned to one side of first motor 58. Second motor 62 is coupled to second shaft 64, which is coupled to second gear 68. When second motor 62 is activated by the control system, second shaft 64 and second gear 68 are rotated. Second gear 68 is interlocked with first gear 66, as shown in the front view of first gear 66 and second gear 68 in FIG. 3. When second gear 68 rotates, first gear 66 is also rotated.

First gear 66 is rotatably coupled to first shaft 60 so that when first shaft 60 is rotated by first motor 58, first gear 66 allows shaft 60 to freely rotate and does not itself rotate. First gear 66 is rotated when second motor 62 causes second gear 68 to rotate. Rigidly coupled to first gear 66 is third shaft 70, which is centered on axis A and extends to display face 38, where pointer 42*a* is coupled to the end of the third shaft. The third shaft 70 also preferably extends from first gear 66 toward motor 58 for a short distance to allow sensor wheel 69 to be coupled to the third shaft (explained below). Third shaft 70 is preferably a hollow sleeve and first shaft 60 is positioned inside the third shaft centered on axis A. First shaft 60 extends past the end of third shaft 70 and pointer 42*a* near display face 38 so that pointer 42*b* can be coupled to the first shaft. This concentric arrangement of first and third shafts allows first shaft 60 and pointer 42*b* to be rotated by first motor 58 independently of third shaft 70 and pointer 42*a*, which are rotated by second motor 62. In the preferred embodiment, first motor 58 can be controlled to rotate first shaft 60 at one speed and/or direction, and second motor 62 can be controlled to rotate second shaft 64 at a different speed and/or direction, allowing the operator of game apparatus 10 to widely vary the difficulty of the game.

Other arrangements can be implemented to independently rotate pointer 42*a* and 42*b* (and any other additional pointers, if appropriate). For example, other types of mechanisms, such as a pulley system, can be used instead of gears 66 and 68 to transmit a rotational force to pointer 42*a*. Second motor 62 can also be positioned in other orientations with reference to first motor 58, such as perpendicularly, on the same axis, etc.

First sensor wheel 69 is used to sense the position of pointer 42*a*. Sensor wheel 69 is coupled to shaft 70 driven by second motor 62 and first gear 66. First sensor 71 is preferably coupled to support member 56 and is positioned such that the edge of sensor wheel 69 is positioned within a sensing region of sensor 71. Sensor 71 preferably is an electromagnetic sensor which includes an emitter 73 and a detector 75. Emitter 73 projects a beam of electromagnetic energy, such as infrared light, toward detector 75. The detector can detect when the beam is being transmitted and when it is being blocked by sensor wheel 69 and can send an appropriate signal to the control system.

Figure 4:
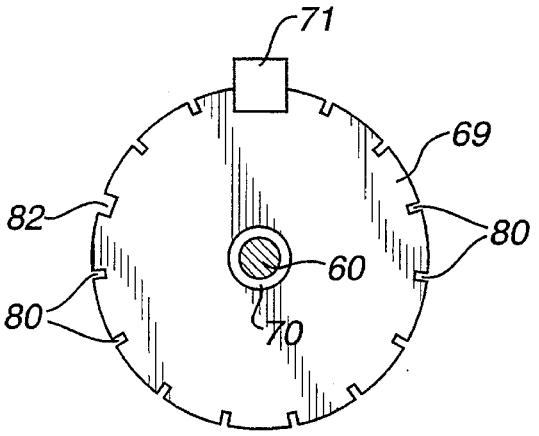
FIG. 4 is a front view taken along line 4—4 of FIG. 2 of a sensor mechanism of the present invention.

FIG. 4 is a front view of first sensor wheel 69 and first sensor 71. Sensor wheel 69 preferably includes a plurality of notches 80 spaced equidistant from each other about the circumference of sensor wheel 69. As wheel 69 is rotated and a notch 80 passes through sensor 71, the beam projected from emitter 73 is allowed to pass through the notch and is detected by detector 75. The locations of the notches are thus detected by sensor 71 as wheel 69 is rotated.

Notches 80 preferably correspond in number and in location on wheel 69 to the number and location of indicia 40 displayed on display face 38 of game apparatus 10. For example, a number or symbol is shown on display face 38 in about the same relative locations as the notches 80. By counting the number of notches that have passed through sensor 71 as shaft 60 and wheel 69 is rotated, the control system can determine which indicium on display face 38 that pointer 42*a* is pointing to. A reference notch 82 is preferably made distinguishable from the other notches 80; for example, in the preferred embodiment, reference notch 82 is made wider to allow the beam emitted from emitter 73 to be detected by detector 75 for a longer period of time. When reference notch 82 is detected, the control system knows that pointer 42*a* is pointing to a specific reference indicium on display face 38. For example, when reference notch 82 is detected, pointer 42*a* is pointing straight up at the indicium at the top of display face 38 ("1" in FIG. 1).

Sensor wheel 72 is preferably similar to sensor wheel 69 and is used to sense the position of pointer 42*b*. Sensor wheel 72 is coupled to shaft 60 driven by first motor 58. A sensor 74 is preferably coupled to support member 56 and is positioned such that the edge of sensor wheel 72 is positioned within a sensing region of sensor 74 to detect notches in wheel 72 similar to sensor 71. Sensor 74 is preferably an electromagnetic sensor which includes an emitter 76 and a detector 78 and operates similarly to sensor 71. Other sensor types can also be used to detect the positions of pointers 42*a* and 42*b* in alternate embodiments.

Figure 5:
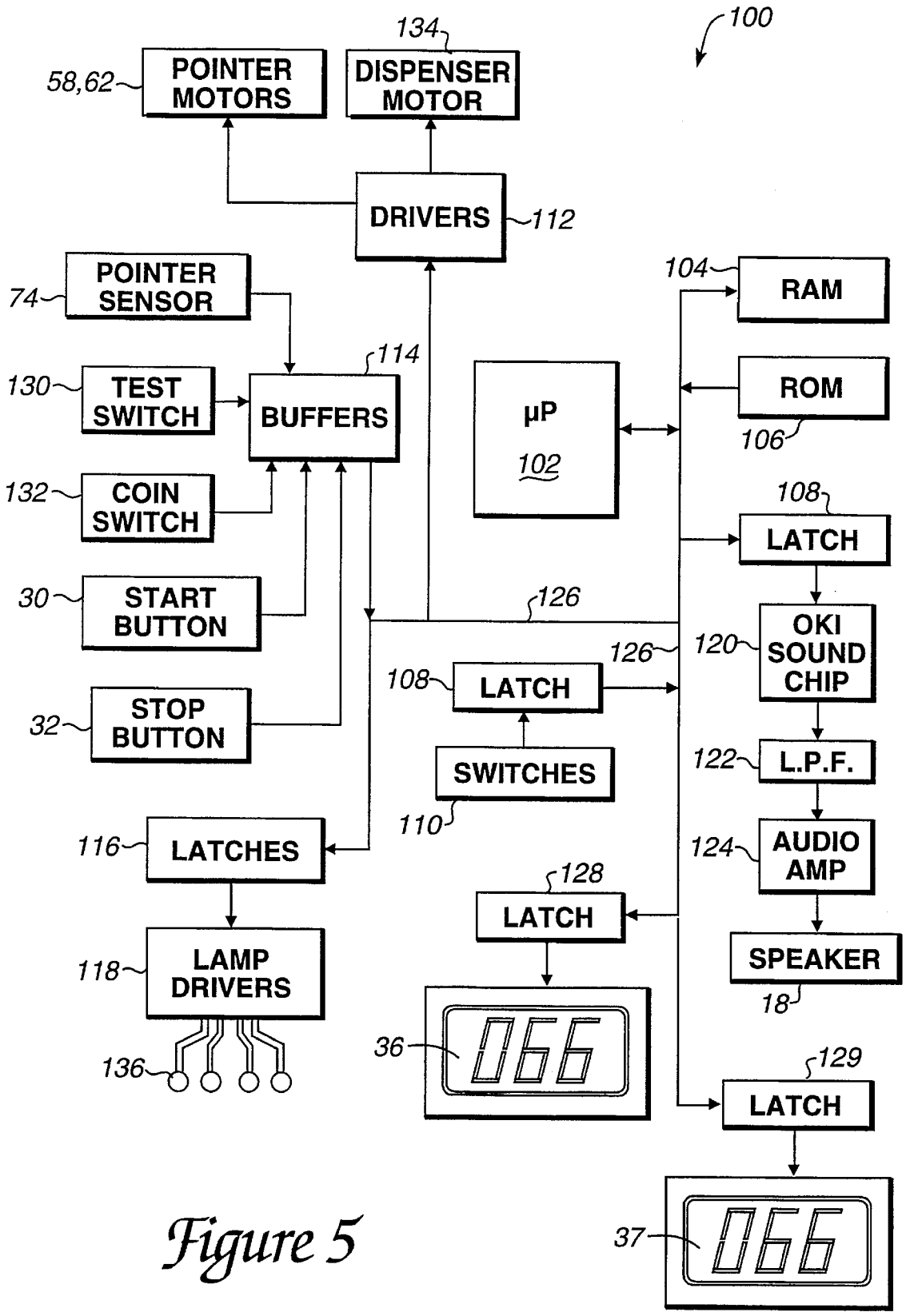
FIG. 5 is a block diagram of a control system used in the game apparatus of FIG. 1.

FIG. 5 is a block diagram of a control system 100 of game apparatus 10. The control system, for example, can be implemented on one or more printed circuit boards which can be located in the interior of game apparatus 10, for example, on a side in the interior of the game apparatus. The components of control system 100 include a microprocessor 102, random access memory (RAM) 104, read-only memory (ROM) 106, a latch 108, DIP switches 110, a game score display 36, drivers 112, buffers 114, latches 116, lamp drivers 118, sound chip 120, low pass filter 122, audio amplifier 124, and speaker 18.

The microprocessor 102 is preferably an 8-bit microprocessor, such as the Intel 8031, which has the range of features adequate for the task, including eight data lines and sixteen address lines. The microprocessor preferably executes software instructions that can be stored in memory, as explained below. Microprocessor 102 is coupled to ROM 106 by a data/address/control bus 126. The ROM 106 is preferably an erasable, programmable read-only memory (EPROM) that contains the start-up instructions and operating system for the microprocessor 102. Microprocessor 102 is connected to RAM 104 by bus 126 to permit the use of RAM for scratch-pad memory. Methods for coupling ROM 106 and RAM 104 to the microprocessor 102 by bus 126 including enable, address, and control lines are well-known to those skilled in the art.

The microprocessor 102 is also coupled to a latch 108 by the bus 126. The switches 110 coupled to latch 108 provide selectable functions that the operator of the game unit may change to his or her liking. These selectable functions include the amount the score is incremented depending on the particular indicia pointed to by pointers 42*a* and 42*b*, the amount of tickets dispensed based on the score, the speed of the motors rotating pointers 42*a* and 42*b*, the direction of the rotation of each of the pointers, the conditions required to receive an award, the conditions required for a player to win a progressive bonus, etc. These factors can affect the difficulty of the game and the amount of awards received by players. Other functions selectable by switches 110 include sound effects, the test mode, the type of game, and so on, depending on how many selectable functions are desired. Switches 110 can, for example, be implemented as DIP switches. Alternatively, the functions selected by switches 110 can be selected from another input device, such as a control panel of buttons, or through software commands to the microprocessor 102.

The microprocessor 102 is also coupled to score displays 36 and 37. The bus 126 connecting the microprocessor 102 to the score displays 36 is latched by a latch 128. Score display 37 is similarly connected to microprocessor 102 by latch 129. The score displays can be one or more 7-segment LED digit displays or similar displays.

The microprocessor 102 is also coupled to drivers 112 and buffers 114. Buffers 114 receive data from several switches and sensors, including test switch 130, coin slot switch 132, pointer sensor 71 and 74, spin button 30, and stop button 32. Test switch 130 can be a switch located in the interior of game apparatus 10 accessible to the operator which activates a test mode for the game apparatus 10 to determine if the game is operating correctly. Coin slot switch 132 detects when a coin has been inserted into coin slot 28 of the game apparatus. Pointer sensors 71 and 74 sense the number of notches 80 on sensor wheel 69 and 72, respectively, which have rotated past the sensors. Microprocessor 102 can use information such as a look up table stored in ROM 106, for example, to correlate the number of notches sensed past the reference notch 82 with indicia on display face 38 representing a score or other game effect. The look-up table can include entries for the number of notches detected and the corresponding numeric (or symbolic, etc.) value of the indicia for each number of notches. Software look-up tables are well known to those skilled in the art. In the preferred embodiment, one look-up table is used for both pointers 42*a* and 42*b*. For example, a counter for each pointer can be incremented or decremented for each notch counted. A counter for pointer 42*a* can start at 0 and be incremented for each notch up to the number of indicia on the display face (and notches), and a counter for pointer 42*b* can start at the number of indicia (e.g., 40) and be decremented down to 0 before being reset. The counters can thus represent one pointer moving clockwise and the other pointer moving counterclockwise. Other counters for additional pointers can be used as well. In an alternate embodiment, a different look-up table can be used for each pointer in the game.

Spin button 30, when pressed by a user, causes microprocessor 102 to activate pointer motors 58 and 62 and rotate pointers 42*a* and 42*b*. Stop button 32, when pressed by a user, causes microprocessor 102 to deactivate motors 58 and 62 and stop pointers 42*a* and 42*b* from rotating.

Drivers 112 activate and drive output devices including pointer motors 58 and 62 for rotating pointers 42*a* and 42*b* and dispenser motor 134 for dispensing an award from dispenser 20.

The microprocessor 102 is also coupled to latches 116 which latch data for the lamp drivers 118. The lamp drivers 118 supply power to the lamps 136, which include, for example, light sources for illuminating indicia 40 on display face 38 when a pointer points to that indicia as well as additional lamps provided around the perimeter of display face 38, front panel 12, and other similar areas of game apparatus 10 which can be highlighted as part of game action. In the preferred embodiment, components such as the motors 58, 62 and 134 and lamps 136 are powered by a commercially available 110 V AC power supply and power converters, which are well known in the art.

The microprocessor 102 is also coupled to a sound chip 120 which can be, for example, an OKI Voice Synthesis LSI chip available from OKI Semiconductor of San Jose, Calif. that has eight data input lines coupled to the microprocessor 102 by a latch 140. The sound chip 120 can receive its data from ROMs (not shown) and preferably outputs sound data to a low pass filter 122, an audio power amplifier 124, and finally to the output speaker(s) 18, which generate sounds to the player playing the game apparatus 10, as is well known to those skilled in the art.

The preferred embodiment of the control system 100 operates briefly as follows. The microprocessor 102 first reads the low memory from ROM 106 over bus 126 and sequences through the software instructions stored in ROM. The settings of DIP switches in the switches block 110 are also read into the microprocessor. The software from the ROM 106 then instructs the microprocessor 102 to send and receive data over the bus 126 in order to conduct a game. For example, when the coin slot switch 132 is activated, indicating a coin has been inserted into coin slot 24, the microprocessor receives a signal from buffers 114 on bus 126. The microprocessor also receives signals when spin button 30 and stop button 32 are activated by the player. The microprocessor sends signals to the drivers 112 over bus 126 to control motors 58 and 62 as appropriate to game action. The microprocessor reads information from sensors 71 and 74 through buffers 114 to determine the indicia pointed to by pointers 42*a* and 42*b*. The microprocessor sends appropriate output signals over bus 126 to update game score display 36 and activate speaker 18 and lamps 136. Once the game is over, the microprocessor activates dispenser motor 134. The method of operation of the preferred embodiment of the game apparatus is described in greater detail with respect to FIG. 8.

Figure 6:
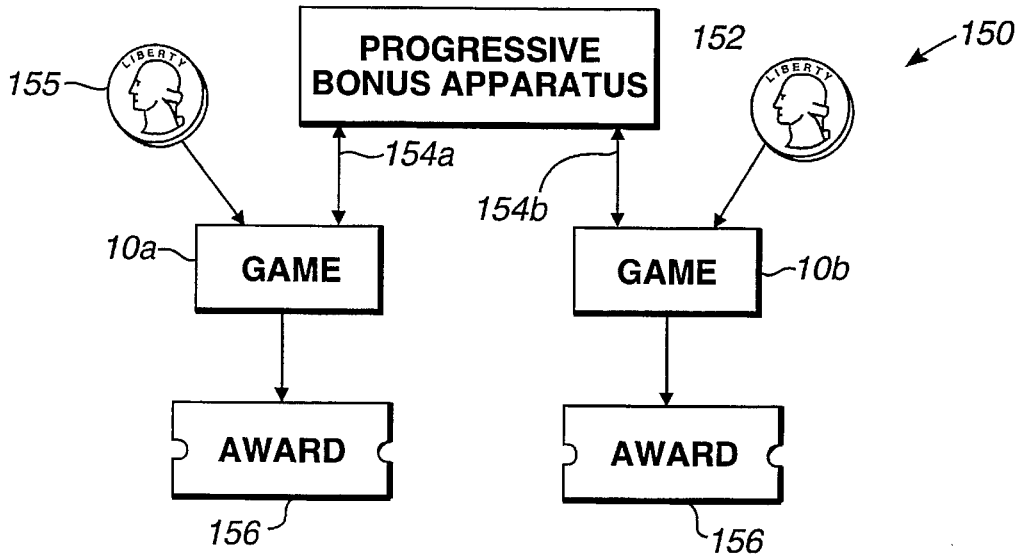
FIG. 6 is a block diagram of a multi-station game apparatus in accordance with the present invention.

FIG. 6 is a diagrammatic illustration of a multi-station game apparatus 150 that receives tokens and dispenses awards with a progressive bonus apparatus in accordance with the present invention.

Multi-station game apparatus 150 includes a progressive bonus apparatus 152 coupled to a first individual game apparatus 10*a* and a second individual game apparatus 10*b*. Further individual game apparatus 10 may be coupled to the progressive game apparatus 152 as desired. The progressive bonus apparatus preferably is positioned exterior to the game apparatus 10*a* and 10*b*, and includes a progressive score display viewable by players of every coupled game apparatus 10*a* and 10*b*.

Each individual game apparatus 10*a* and 10*b* has the ability to be played on its own as described in FIGS. 1–5 above, independent of other game apparatus 10 coupled to progressive bonus apparatus 152. Note that each individual game apparatus 10 already preferably provides progressive scoring ability for the single apparatus only, as shown by score display 37. If a single individual game apparatus 10 is played as a stand-alone game, the progressive score of display 37 is preferably incremented whenever a player inserts a coin or token into coin slot 28. The progressive score is counted by microprocessor 102 of the control system and is added to the game score shown by display 36 when the player achieves a progressive goal. The progressive goal in the preferred embodiment is to stop one or both pointers 42*a* and 42*b* on the jackpot indicia 45 for three "spins" in a row. An award based upon the combined score (game score and progressive score) is then dispensed to the player. Other variations can be made to the individual progressive score similar to variations described below for the multi-game progressive score.

When multiple game apparatuses 10*a* and 10*b* are being used, progressive bonus apparatus 152 can be provided to display the current progressive score and provide a progressive bonus award to a winning player. Each game apparatus 10*a* and 10*b* is thus able to access a progressive score contributed to by all connected game apparatuses. This is described below.

A player inserts one or more tokens 155 or other monetary input into an individual game unit 10*a* and 10*b*. Each game unit 10*a* and 10*b* is connected to the progressive bonus apparatus 152 by a data bus 154*a* and 154*b*, respectively.

The progressive bonus apparatus 152 shows the current progressive score on a score display (see FIG. 9) which starts at a predetermined value. For example, the progressive score might be set at a starting score of zero. Or, so that a bonus award might be immediately available to players, the starting score could be set at a higher value.

In the multi-game system of FIG. 6, the progressive score is preferably accumulated using a microprocessor in apparatus 152 from contributions by the individual game apparatus 10*a* and 10*b* over the data busses 154*a* and 154*b*. The contributions can be determined in a variety of ways. In the preferred embodiment, each game apparatus 10*a* and 10*b* sends a signal to the progressive bonus apparatus 152 whenever a player deposits a coin into coin slot 28 of game apparatus 10*a* or 10*b*. When the progressive bonus apparatus 152 receives this signal, it increments the progressive score by one, ten, one-half, or another predetermined value. Thus, each game apparatus 10*a* and 10*b* that is played will increment the progressive score by this value. Other methods might be used where the game apparatus 10*a* or 10*b* sends its increment signal when a player reaches a predetermined score or achieves a goal. Also, the progressive bonus apparatus 152 could be set to multiply the progressive score by a selected quantity whenever an individual game apparatus 10*a* or 10*b* sends an increment signal.

Also, in the described embodiment, each individual game apparatus 10*a* and 10*b* displays the current progressive score on display 37 of the game apparatus. After progressive bonus apparatus 152 receives signals from the individual game apparatuses to increment the progressive score, apparatus 152 can send out signals to all the individual game apparatuses 10*a* and 10*b* providing the current progressive score. The current progressive score can thus be displayed on progressive bonus apparatus 152 and on each individual game apparatus.

Each individual game apparatus 10*a* and 10*b* has one or more progressive goals for the player to accomplish in order for the player to receive a bonus award 156 based on the progressive score. All game apparatus 10*a* and 10*b* that are attached to a single progressive bonus apparatus 152 preferably require the same progressive goal, so that each player competing for the progressive score has a task of the same duration and level of difficulty. The progressive goal has several possible variations. In the preferred embodiment, the progressive goal can be achieved by attaining a certain result on display face 38 multiple times in a row. For example, if a player stops the pointers so that either or both of the pointers points to the "jackpot" symbol for three separate "spins" in a row, then the player has achieved the progressive goal. In other embodiments, a player can also achieve the progressive bonus award by achieving a certain high score after a game, selecting a predetermined set of score results, etc. Other variations of progressive goals can also be implemented to receive a progressive bonus award.

The first player of a game apparatus 10*a* or 10*b* coupled to apparatus 152 that accomplishes the progressive goal is entitled to a bonus award 156 based on the progressive score. The bonus award can be tickets, prizes, etc., as described above. The bonus apparatus 152 can send the progressive score data over data bus 154 to the winning game apparatus 10*a* or 10*b*, if necessary. The winning game apparatus 10*a* or 10*b* can dispense the bonus award 156 to the player by that game apparatus's 10 normal award dispenser 20. The progressive score of apparatus 152 is then reset to its beginning state. Alternatively, the bonus award 156 can be given manually to the winning player by the owner or operator of the multi-station game apparatus 150.

Figure 7:
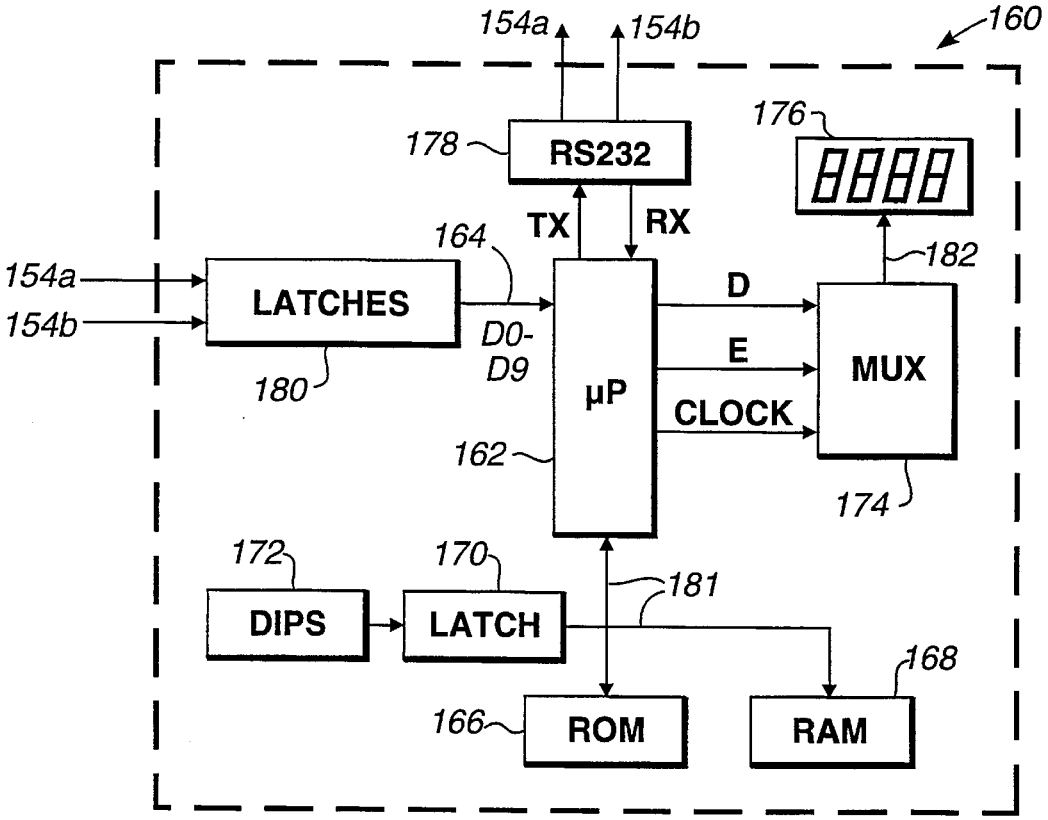
FIG. 7 is a block diagram of a control system for a progressive bonus apparatus used in the multi-station game apparatus of FIG. 6.

FIG. 7 is a block diagram of a control system 160 for the progressive bonus apparatus 152. The control system 160 includes a microprocessor 162, data bus 164, read-only memory (ROM) 166, random-access memory (RAM) 168, a latch 170, DIP switches 172, a multiplexer 174, an LED display 176, and an RS-232 port 178.

The microprocessor 16 2 is preferably an 8-bit microprocessor, such as the Intel 8031 as described above in FIG. 5. The microprocessor 162 receives data inputs D0–D9 inputs on data bus 164 from individual game apparatus that are connected to the progressive bonus apparatus 152; one data line is required per game apparatus, so ten individual games can be connected to the progressive bonus apparatus in this embodiment. Data latches 180 are used to couple the data busses from each unit (such as data busses 154*a* and 154*b*) to the data bus 164.

The microprocessor 162 is coupled to ROM 166 by an address/control/data bus 181. The ROM 166 is preferably an erasable programmable read-only memory (EPROM) that contains the start-up instructions and operating system for the progressive bonus apparatus. Microprocessor 162 is connected to RAM 168 by the bus 181 to permit the use of RAM as scratch-pad memory.

The microprocessor 162 is also coupled to a latch 170 and DIP switches 172 by bus 181. The DIP switches 172 provide selectable functions that the owner or operator of the progressive bonus apparatus 152 may change to his or her liking. These selectable functions include setting the base payout score that the progressive bonus apparatus 152 will display in its starting state, and the increment value that the apparatus will use to increase the progressive score whenever a player achieves the progressive goal. Other selectable functions could also be set by the DIP switches depending on how many selectable game options and features are desired.

The microprocessor 162 is also coupled to a multiplexer 174. The multiplexer 174 receives a clock signal, an enable signal, and a serial LED data signal from the microprocessor 162. The multiplexer then outputs control signals to the segments of the LED display 176 on a bus 182 to display the progressive apparatus score.

The progressive bonus apparatus can also send and receive message signals through a standard RS-232 interface 178. Other interface standards, such as RS-485, can also be used. The RS-232 interface allows the control system 160 to send signals to individual game apparatus 10*a* and 10*b* over busses 154*a* and 154*b*, respectively. The RS-232 port can also be coupled to a computer system or other data processing system to allow the control and analysis of the control system 160.

The control system 160 for the progressive bonus apparatus 152 operates as follows. The microprocessor 162 sequences through the software instructions stored in ROM and then reads the DIP switches 172, reads the game apparatus signals on busses 154*a* and 154*b* from the latches 170, and displays or updates the score LED display 176 with the information from the game apparatus signals. If a game apparatus signal on busses 154*a* or 154*b* indicates a token has been inserted in an individual game apparatus 10*a* or 10*b*, the microprocessor increments the progressive score. When a game apparatus signal on busses 154*a* or 154*b* indicates that a progressive goal has been achieved on a game apparatus 10*a* or 10*b*, microprocessor 162 sends signals to, for example, flash the apparatus score display 176 and activate lights and sound speakers (not shown) indicating the bonus has been won. In the preferred embodiment, a bonus award based on the combined score of game score and progressive score is then dispensed to the player who won, preferably using the dispenser 34 of the winning game apparatus 10.

Figure 8:
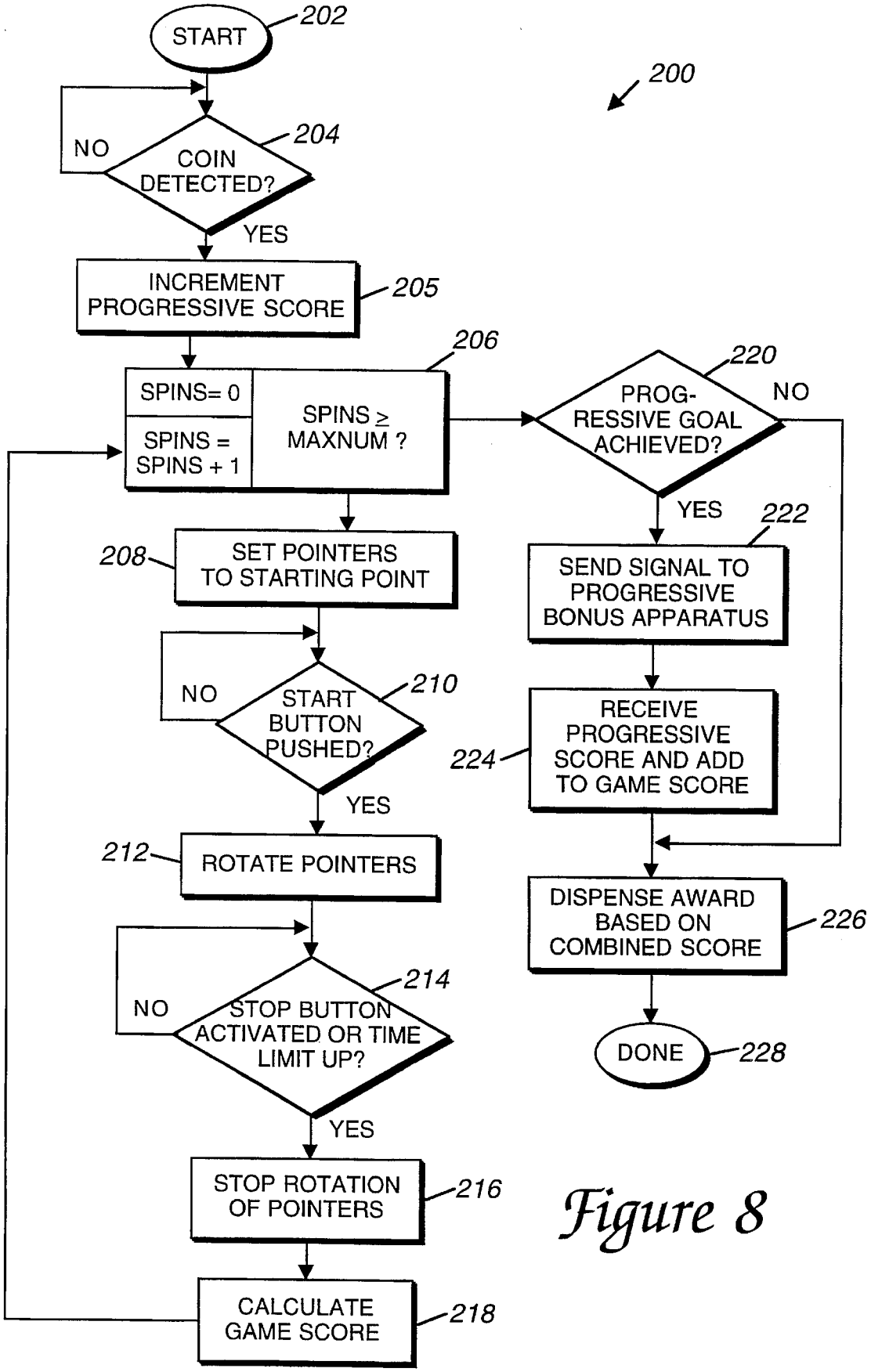
FIG. 8 is a flow diagram illustrating the method of playing and operating the game apparatus of FIG. 1.

FIG. 8 is a flow diagram illustrating a method 200 of operating and playing game apparatus 10. The process begins at 202. In step 204, the microprocessor checks if a coin has been inserted into coin slot 28 by checking a signal from coin slot switch 132. If no coin is detected, step 204 is repeated until a coin is detected. In step 205, the progressive score is incremented and displayed on score display 37. If a multi-game system with a progressive bonus apparatus 152 is being used, the microprocessor of the game apparatus also sends a signal to the progressive bonus apparatus to increment the progressive score and receives an updated progressive score signal from apparatus 152. Note that the microprocessor can receive an updated progressive score signal from apparatus 152 any time during the process 200 or even when a game is not being played, since players can play other connected game apparatuses at any time.

In step 206, the variable SPINS is initialized to zero and the microprocessor checks if SPINS is greater than or equal to MAXNUM, which is the number of separate "spins" that a player receives with the insertion of one coin. A "spin" is one start and stop of the rotation of pointers 42*a* and 42*b* by pressing spin button 30 and stop button 32, respectively. In some embodiments, MAXNUM=1 so that the player only gets one opportunity to start and stop the rotation of the pointers.

If SPINS is less than MAXNUM, step 208 (optional) is implemented, in which the microprocessor sets pointers 42*a* and 42*b* to a starting position, such as pointing towards the top of the game apparatus. This starting position provides the pointers in a standard position for the player when a game starts and allows the notches of sensor wheels 69 to be counted from a reference position. To accomplish this, the microprocessor can drive motors 58 and 62 to rotate the pointers to the desired position using sensor 74 to detect reference notch 82. In step 210, the microprocessor checks if the spin button has been activated by the player. If not, the microprocessor continues to check for the start button being pushed at step 210. Optionally, the microprocessor can automatically end the game if the player does not push the start button within a predetermined time limit after inserting a coin. If the player activates the spin button, then step 212 is implemented, in which the pointers 42*a* and 42*b* are rotated by activating the pointer motors. In the described embodiment, pointer 42*a* is rotated clockwise and pointer 42*b* is rotated counterclockwise. In alternate embodiments, the pointers can be rotated in the same direction. In yet other embodiments, the rotational directions and/or speeds of the pointers can be changed for different spins. For example, for the first spin, the pointers can rotate in opposite directions; for the next spin, the pointers can rotate in the same direction at different speeds, etc.

In step 214, the microprocessor checks if stop button 32 has been activated by the player or if a time limit since the start button was activated has expired. If neither of these conditions is true, then the microprocessor continues to check for these conditions in step 214 while rotating the pointers. If either of these conditions is true, then the rotation of the pointers is stopped in step 216 by deactivating the motors. In step 218, a game score is calculated based upon the indicia 40 pointed to by the pointers (determined by sensors 71 and 74).

In the preferred embodiment, indicia 40 are numbers, and the values of the numbers pointed to by the pointers 42*a* and 42*b* are summed to achieve a game score. If this is the player's second or later spin (i.e., the variable SPINS=1 or greater), then the current score indicated by the pointers is preferably added to any game score value that has been accumulated in previous spins. Other variations are also possible to achieve game score; for example, the values of the numbers can be multiplied, subtracted, etc.

In an alternate embodiment, indicia 40 can be shown as other types of symbols, and a game score can be based upon a combination of symbols pointed to by pointers 42*a* and 42*b*. For example, game apparatus 10 can simulate the game of blackjack, and indicia 40 can be playing card symbols each indicating a card number and suit. As an example, one pointer 42*a* can represent the player's hand of cards, and another pointer 42*b* can represent a "dealer's" hand of cards. A player can use up to three spins to try to stop the pointers so that the player's card total will add up to 21, or as close to 21 as possible without going over 21. At the same time, the player tries to minimize the dealer's card total by stopping the dealer's pointer at low card values or tries to make the dealer card total sum to a value over 21. If a player reaches 21 before the three spins have been used, the player has won and the game is preferably over. The player then receives a game score and/or the progressive score for winning. Alternatively, the game score can be based on how close the player's card total is to 21, with the maximum score corresponding to a card total of 21. Other similar types of games can also be implemented with game apparatus 10 of the present invention, such as poker, a slot machine style game, roulette, etc. Or, other types of symbols such as animals, faces, colors, letters, etc. can be displayed and the player can try to stop multiple pointers to point at a particular winning combination of symbols.

In yet another embodiment, the indicia 40 can be numbers (representing, for example, cards). The player has multiple spins and may select a predetermined number of spin results to try to achieve a winning result. For instance, a player may get four spins during one game. The result of each spin can be displayed on a score display similar to score display 36. The results of only two spins are shown at once. Thus, after two spins, the player can decide whether to select one or both of the displayed spin results. The player then gets two more spins, and may select either or both of the results. The final game score depends on the player's selection of the best three out of the four results. For example, as in poker, a result of "three of a kind" or all results having the same card suit would result in a greater game score. Or, the player could try to spell a word with letter indicia 40 by picking specific results. The progressive goal can also be implemented as a selection of spin results, such as spelling the word "jackpot" from multiple spins.

After calculating and displaying a game score, the process returns to step 206, where the microprocessor increments SPINS and again checks if SPINS is greater than or equal to MAXNUM. When this is true, step 220 is implemented, in which the microprocessor checks if the progressive goal was achieved by the player. In the described embodiment, a progressive goal is achieved when the player stops a pointer at the symbol "jackpot" on display face 38 for 3 consecutive spins. This is preferably the progressive goal whether a game apparatus 10 is being played individually with an individual progressive score or with multiple game apparatuses and a progressive bonus apparatus 152.

If the progressive goal was not achieved by the player, the process continues to step 226, detailed below. If the progressive goal was achieved by a player of a game apparatus within a multi-game environment, then the microprocessor sends a signal to the progressive bonus apparatus 152 in step 222. The signal indicates that the progressive goal has been achieved and includes the identity of the winning individual game apparatus 10. In step 224, the progressive score is received by the winning game apparatus from the progressive bonus apparatus and the progressive score is added to the game score of the individual game apparatus 10, resulting in a combined score.

If only one game apparatus is being operated individually, then step 222 is not implemented, since the microprocessor of the game appparatus would keep track of the progressive score and would know when the progressive score was achieved by the player. In such an embodiment, the microprocessor would add the progressive score to the game score in step 224, resulting in a combined score.

In next step 226, an award based on the combined score is dispensed to the player from award dispenser 20 of the winning individual game apparatus 10. For example, one award ticket can be dispensed for each point of game score. Alternatively, one award ticket can be dispensed for every X scored points; for example, X=10. Alternatively, an operator of the game apparatus can manually provide an award to the winning player based upon the combined score. The game is then complete as indicated at 228. A player can insert a coin into coin slot 28 to begin another game at any time.

In other embodiments, the progressive score and game score can be calculated separately. For example, an award based on the game score can be dispensed to the player after each spin or after all spins, and then an award based on the progressive score can be dispensed. Alternatively, the award based on the individual game score can be dispensed by dispenser 20 and the award based on the progressive score can be manually provided by an operator of the game apparatus. In those embodiments which do not include a progressive score or a progressive bonus apparatus, steps 220, 222 and 224 can be ignored, and step 226 would dispense an award based on the game score, not the combined score.

While this invention has been described in terms of several embodiments, it is contemplated that alterations, modifications and permutations thereof will become apparent to those skilled in the art upon a reading of the specification and study of the drawings. For example, many types and forms of indicia 40 can be displayed on display face 38, and the indicia can be arranged in many types of patterns and configurations. A player can try to point to various combinations of indicia with two or more pointers and/or can select one or more spin results from multiple spins to obtain a game score and awards associated therewith. It is therefore intended that the following claims include all such alterations, modifications and permutations as fall within the spirit and scope of the present invention.

What is claimed is:

1. A game apparatus comprising:

a display face having a plurality of indicia provided thereon;

a plurality of pointers that rotate about an axis extending perpendicularly from said display face;

a rotation mechanism for rotating said plurality of pointers;

a control mechanism operative to disable said rotation mechanism to allow a player to stop said plurality of pointers from rotating; and a scoring mechanism operative to provide a game score based on said indicia that said pointers are pointing to after said pointers have stopped rotating.

2. A game apparatus as recited in claim 1 wherein said plurality of pointers include a pointer that rotates in a clockwise direction and a pointer that rotates in a counterclockwise direction.

3. A game apparatus as recited in claim 1 wherein said pointers include elongated members such that one end of said members is positioned at said axis and an opposite end of said members points to said indicia.

4. A game apparatus as recited in claim 1 wherein said indicia include a plurality of numerals.

5. A game apparatus as recited in claim 4 wherein said scoring mechanism provides a game score by summing the numerical value of said numerals pointed to by said pointers.

6. A game apparatus as recited in claim 5 wherein said control mechanism includes a stop button.

7. A game apparatus as recited in claim 6 further comprising a digital computer for controlling said game apparatus.

8. A game apparatus as recited in claim 1 further comprising a spin control operative to cause said rotation mechanism to rotate said pointers.

9. A game apparatus as recited in claim 8 wherein said rotation mechanism includes a plurality of motors for rotating said pointers.

10. A game apparatus as recited in claim 9 wherein said rotation mechanism includes a sensor wheel and a sensor to indicate to said scoring mechanism said indicia to which said pointers are pointing.

11. A game apparatus as recited in claim 8 further comprising an award dispenser for dispensing an award based upon said game score.

12. A game apparatus as recited in claim 1 wherein said indicia include card symbols.

13. A game apparatus as recited in claim 1 further comprising a progressive bonus apparatus for accumulating a progressive score contributed to by a plurality of said game apparatus.

14. A game apparatus having multiple rotating pointers, the game apparatus comprising:

a plurality of pointers that rotate about an axis;

a rotation mechanism for causing said pointers to simultaneously rotate about said axis;

a user activated stop mechanism for causing said pointers to simultaneously stop rotating and rest at stopped positions; and a scoring mechanism for calculating a game score based on said stopped positions of said pointers.

15. A game apparatus as recited in claim 14 wherein said plurality of pointers include a pointer that rotates in a clockwise direction and a pointer that rotates in a counterclockwise direction.

16. A game apparatus as recited in claim 14 wherein said pointers include elongated members that rotate about said axis.

17. A game apparatus as recited in claim 16 wherein said rotation mechanism includes a plurality of shafts, each shaft being coupled to one of said pointers, and a plurality of motors, each of said motors coupled to and operative to rotate one of said shafts.

18. A game apparatus as recited in claim 17 wherein a first one of said shafts coupled to a first one of said pointers is positioned inside a second one of said shafts and is independently rotating therefrom.

19. A game apparatus as recited in claim 18 wherein said rotation mechanism includes a plurality of gears for coupling one of said motors to said second one of said shafts and to allow said motor to rotate said second one of said shafts.

20. A game apparatus as recited in claim 18 wherein said rotation mechanism includes a sensor assembly operative to determine to which indicia said pointers are pointing.

21. A game apparatus as recited in claim 20 wherein said sensor assembly includes a sensor wheel having a plurality of notches and an emitter/detector for sensing the positions of said notches as said sensor wheel is rotated.

22. A game apparatus as recited in claim 20 wherein said scoring mechanism includes a game score display for providing said game score to a player of said game apparatus.

23. A game apparatus as recited in claim 20 further comprising a digital computer for controlling said rotation mechanism, said stop mechanism, and said scoring mechanism.

24. An arcade game as recited in claim 14 further comprising a plurality of said arcade games and a progressive bonus apparatus coupled to said plurality of arcade games, said progressive bonus apparatus accumulating a progressive score contributed to by said arcade games.

25. A method for playing an arcade game having a plurality of rotatable pointers, the method comprising the steps of:

(a) providing a plurality of pointers;

(b) rotating said pointers about a single axis;

(c) stopping said pointers to rest at stopped positions; and (d) providing a game score based on said stopped positions of said pointers.

26. A method as recited in claim 25 wherein said step of rotating said pointers about said axis is accomplished after a player activates a control to begin said rotation.

27. A method as recited in claim 26 wherein said step of stopping said pointers is accomplished when a player activates a control.

28. A method as recited in claim 27 wherein said plurality of pointers point to indicia provided on a display face, and wherein said game score is based said indicia pointed to by said pointers.

29. A method as recited in claim 28 further comprising a step of repeating steps (a) through (d) a predetermined number of times and adding said game scores resulting from said repeated steps to provide a final game score.

30. A method as recited in claim 28 further comprising a step of contributing to a progressive score and providing a progressive bonus award to said player based on said progressive score when said player achieves a progressive goal.

31. A method as recited in claim 28 wherein said game score is the sum of numeral indicia pointed to by said pointers.

32. A method as recited in claim 28 further comprising a step of providing an award to a player based upon said game score.

33. A method as recited in claim 32 wherein said pointers are elongated members having one end positioned at said axis and an opposite end pointing to said indicia.

34. A method as recited in claim 30 wherein at least two of said pointers are rotated in opposite directions.

35. A method as recited in claim 25 further comprising a step of providing a progressive bonus apparatus coupled to a plurality of said arcade games, wherein said progressive bonus apparatus increases a progressive score when a player operates one of said arcade games and provides an award based upon said progressive score to a winning player when said winning player achieves a progressive goal during a game.

* * * * *